US006547369B1

(12) United States Patent
Temple

(10) Patent No.: US 6,547,369 B1
(45) Date of Patent: Apr. 15, 2003

(54) LAYERED CLEANING BLADE AND IMAGE FORMING DEVICE ARRANGED WITH THE SAME

(75) Inventor: Donald M. Temple, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/976,427

(22) Filed: Oct. 12, 2001

(51) Int. Cl.[7] ..... B41J 2/165
(52) U.S. Cl. ..... 347/33
(58) Field of Search ..... 347/33, 23, 24, 347/22; 15/250.48, 250.361, 256.5

(56) References Cited

U.S. PATENT DOCUMENTS

| | | | | |
|---|---|---|---|---|
| 5,103,244 A | | 4/1992 | Gast et al. | 347/33 |
| 5,126,765 A | | 6/1992 | Nakamura | 347/33 |
| 5,396,271 A | | 3/1995 | Premnath | 347/33 |
| 5,539,435 A | * | 7/1996 | Uchida et al. | 347/33 |
| 5,555,461 A | | 9/1996 | Ackerman | 347/33 |
| 5,640,182 A | * | 6/1997 | Bahrami et al. | 347/33 |
| 5,943,071 A | | 8/1999 | Premnath | 347/33 |
| 6,213,582 B1 | | 8/2001 | Uchida et al. | 347/33 |

FOREIGN PATENT DOCUMENTS

| | | | | |
|---|---|---|---|---|
| JP | 404338552 A | * | 11/1992 | 347/33 |

* cited by examiner

*Primary Examiner*—Shih-Wen Hsieh
(74) *Attorney, Agent, or Firm*—Wayne J. Egan

(57) ABSTRACT

A layered cleaning blade includes a first surface forming a wiper surface comprised of a relatively low-hardness material for wiping fluid nozzle openings of a fluid ejecting head as the fluid ejecting head moves in a direction toward the wiper surface and a second surface forming a scraper edge comprised of a relatively high-hardness material for scraping the fluid nozzle openings as the fluid ejecting head moves in the opposite direction. The layered cleaning blade thereby optimizes the fluid ejecting head cleaning process by combining both the fluid nozzle opening wiping function and the fluid nozzle opening scraping function in a single cleaning blade.

40 Claims, 10 Drawing Sheets

LAYERED CLEANING BLADE AND IMAGE FORMING DEVICE ARRANGED WITH THE SAME

INCORPORATED BY REFERENCE

The disclosure of U.S. Pat. No. 5,103,244 to Paul D. Gast et al., entitled "Method and apparatus for cleaning ink-jet printheads," issued Apr. 7, 1992, (hereinafter "Gast") is hereby incorporated by reference verbatim, with the same effect as though such disclosure were fully and completely set forth herein.

The disclosure of U.S. Pat. No. 5,126,765 to Fumiharu Nakamura, entitled "Ink jet recording apparatus having cleaning means for cleaning a recording head," issued Jun. 30, 1992, (hereinafter "Nakamura") is hereby incorporated by reference verbatim, with the same effect as though such disclosure were fully and completely set forth herein.

The disclosure of commonly-assigned U.S. Pat. No. 5,396,271 to Karai P. Premnath, entitled "Wiper blade cleaning system for non-coplanar nozzle faces of ink jet printheads," issued Mar. 7, 1995, (hereinafter "Premnath '271") is hereby incorporated by reference verbatim, with the same effect as though such disclosure were fully and completely set forth herein.

The disclosure of commonly-assigned U.S. Pat. No. 5,555,461 to John C. Ackerman, entitled "Self cleaning wiper blade for cleaning nozzle faces of ink jet printheads," issued Sep. 10, 1996, (hereinafter "Ackerman") is hereby incorporated by reference verbatim, with the same effect as though such disclosure were fully and completely set forth herein.

The disclosure of commonly-assigned U.S. Pat. No. 5,943,071 to Karai P. Premnath, entitled "Wiper blade cleaning system for nozzle faces of a color printhead," issued Aug. 24, 1999, (hereinafter "Premnath '071") is hereby incorporated by reference verbatim, with the same effect as though such disclosure were fully and completely set forth herein.

The disclosure of U.S. Pat. No. 6,213,582 to Haruo Uchida et al., entitled "Ink jet recording apparatus and mechanism for discharging cleaning and recovery provided for the apparatus," issued Apr. 10, 2001, (hereinafter "Uchida") is hereby incorporated by reference verbatim, with the same effect as though such disclosure were fully and completely set forth herein.

TECHNICAL FIELD

This invention relates to cleaning blades used in image forming devices and more particularly to a layered cleaning blade providing both a low-hardness wiper surface and a high-hardness scraper edge.

BACKGROUND OF THE INVENTION

Image forming devices using fluid ejecting heads to mark a substrate with marking fluids are known. Also, it is known to equip such an image forming device with one or more cleaning blades that act to clean the fluid ejecting head by removing residual marking fluid therefrom. For example, the foregoing Gast patent at col. 5, lines 16–60 describes an inkjet printer device 10 generally shown in FIG. 1 thereof utilizing a printhead carriage 14 including print cartridges 30 and 32, which cartridges each have an associated printhead 31 and 33 provided on a bottom surface thereof, each printing with fluid ink. Gast generally in col. 6 and especially at lines 59–62 thereof describes a wiper mechanism 65 including at least two blades 61 and 63 and preferably four blades 61, 61A, 63 and 63A to wipe the printheads 31 and 33.

Also, the foregoing Nakamura patent at col. 6, lines 39–68 and col. 7, lines 1–34 describes an ink-jet recording apparatus generally shown in FIG. 1 thereof, with an ink recording head 7 containing ink discharge ports. Nakamura in FIGS. 1–2 depicts various embodiments wherein a cleaning blade 1 (shown in FIG. 1) or two cleaning blades 1*a*–1*b* (shown in FIG. 2) are arranged to clean the discharge port 8 in which ink discharge ports 9 are arranged, as comprised in the recording head 7.

Also, the foregoing Premnath '271 patent at col. 3, lines 27–51 describes an ink jet printer 10 generally shown in FIG. 1 thereof with a printhead 12 fixed to ink supply cartridge 14. Premnath '271 in FIGS. 4–5 depicts two cleaning blades 30–31 arranged to clean nozzle face 23 comprising printhead face 80 of printhead 12, the printhead 12 containing plural nozzles 22, the latter nozzles 22 being shown in FIG. 1.

Also, the foregoing Ackerman patent at col. 3, lines 50–67 and col. 4, lines 1–34 describes an ink jet printer 10 generally shown in FIG. 1 thereof with a printhead 12 fixed to ink supply cartridge 14. Ackerman in FIG. 3 depicts two cleaning blades 30–31 cleaning ink nozzles 22 in the printhead 12.

Also, the foregoing Premnath '071 patent at col. 2, lines 63–67 and col. 3, lines 1–64 describes an ink jet printer 10 generally shown in FIG.1 thereof with a printhead 18 having plural recording segments coupled to fluid inks. Premnath '071 in FIG. 1 depicts 2 wiper blades 42–44 arranged to clean recording segments 18A–18D comprising ink nozzles 34 in nozzle face 36.

Also, the foregoing Uchida patent at col. 4, lines 58–67 and col. 5, lines 1–43 describes an ink jet recording apparatus generally shown in FIG. 8 thereof. See also Uchida's FIG. 17 and corresponding text, which discloses an ink jet printer 1907. Uchida in FIG. 8 depicts 2 cleaning blade members 2a–2b supported by 2 holders 11–12 to clean discharging ports 1a of recording head 1.

In existing cleaning blades, however, it is not known to provide both a low-hardness wiper surface and a high-hardness scraper edge in a single cleaning blade.

As a result, there is a need for an improved cleaning blade.

SUMMARY OF THE INVENTION

In one aspect of the invention, there is described a layered cleaning blade comprising an elongated flat blade body forming a flat first surface, a thickness and an opposite flat second surface, a cleaning end and a distal mounting end, a smaller flat wiper blade disposed on the first surface with an outer wiper surface near the cleaning end comprised of a relatively low-hardness material, the second surface forming a scraper edge near the cleaning end comprised of a relatively high-hardness material.

In another aspect of the invention, there is described a layered cleaning blade comprising an elongated flat blade body forming a flat first surface, a thickness and an opposite flat second surface, a cleaning end and a distal mounting end, a smaller first flat wiper blade disposed on the first surface near the cleaning end to expose a first scraper edge comprised in the cleaning end, the outer surface of the first wiper blade near the cleaning end forming a first wiper surface comprised of a relatively low-hardness material, the first scraper edge comprised of a relatively high-hardness material, and a smaller second flat wiper blade disposed on the second surface near the cleaning end to expose a second scraper edge comprised in the cleaning end, the outer surface of the second wiper blade near the cleaning end forming a second wiper surface comprised of a relatively low-hardness material, the second scraper edge comprised of a relatively high-hardness material.

In still another aspect of the invention, there is described a layered cleaning blade arrangement comprising a first layered cleaning blade comprising a first elongated flat blade body forming a flat first surface, a first thickness and an opposite flat second surface, a first cleaning end and a distal first mounting end, a smaller flat first wiper blade disposed on the first surface with an outer first wiper surface near the first cleaning end comprised of a relatively low-hardness material, the second surface forming a first scraper edge near the first cleaning end comprised of a relatively high-hardness material, and a second layered cleaning blade comprising a second elongated flat blade body forming a flat third surface, a second thickness and an opposite flat fourth surface, a second cleaning end and a distal second mounting end, a smaller flat second wiper blade disposed on the third surface with an outer second wiper surface near the second cleaning end comprised of a relatively low-hardness material, the fourth surface forming a second scraper edge near the second cleaning end comprised of a relatively high-hardness material.

In a further aspect of the invention, there is described an image forming device arranged with one or more layered cleaning blades, at least one of the one or more layered cleaning blades comprising an elongated flat blade body forming a flat first surface, a thickness and an opposite flat second surface, a cleaning end and a distal mounting end, a smaller flat wiper blade disposed on the first surface with an outer wiper surface near the cleaning end comprised of a relatively low-hardness material, the second surface forming a scraper edge near the cleaning end comprised of a relatively high-hardness material.

In a still further aspect of the invention, there is described an image forming device arranged with one or more layered cleaning blades, at least one of the one or more layered cleaning blades comprising an elongated flat blade body forming a flat first surface, a thickness and an opposite flat second surface, a cleaning end and a distal mounting end, a smaller first flat wiper blade disposed on the first surface near the cleaning end to expose a first scraper edge comprised in the cleaning end, the outer surface of the first wiper blade near the cleaning end forming a first wiper surface comprised of a relatively low-hardness material, the first scraper edge comprised of a relatively high-hardness material, and a smaller second flat wiper blade disposed on the second surface near the cleaning end to expose a second scraper edge comprised in the cleaning end, the outer surface of the second wiper blade near the cleaning end forming a second wiper surface comprised of a relatively low-hardness material, the second scraper edge comprised of a relatively high-hardness material.

In a yet further aspect of the invention, there is described an image forming device arranged with one or more layered cleaning blade arrangements, at least one of the one or more layered cleaning blade arrangements comprising a first layered cleaning blade comprising a first elongated flat blade body forming a flat first surface, a first thickness and an opposite flat second surface, a first cleaning end and a distal first mounting end, a smaller flat first wiper blade disposed on the first surface with an outer first wiper surface near the first cleaning end comprised of a relatively low-hardness material, the second surface forming a first scraper edge near the first cleaning end comprised of a relatively high-hardness material, and a second layered cleaning blade comprising a second elongated flat blade body forming a flat third surface, a second thickness and an opposite flat fourth surface, a second cleaning end and a distal second mounting end, a smaller flat second wiper blade disposed on the third surface with an outer second wiper surface near the second cleaning end comprised of a relatively low-hardness material, the fourth surface forming a second scraper edge near the second cleaning end comprised of a relatively high-hardness material.

DESCRIPTION OF THE PREFERRED EMBODIMENT

Briefly, a layered cleaning blade includes a first surface forming a wiper surface comprised of a relatively low-hardness material for wiping fluid nozzle openings of a fluid ejecting head as the fluid ejecting head moves in a direction toward the wiper surface and a second surface forming a scraper edge comprised of a relatively high-hardness material for scraping the fluid nozzle openings as the fluid ejecting head moves in the opposite direction. The layered cleaning blade thereby optimizes the fluid ejecting head cleaning process by combining both the fluid nozzle opening wiping function and the fluid nozzle opening scraping function in a single cleaning blade.

Figure 1:
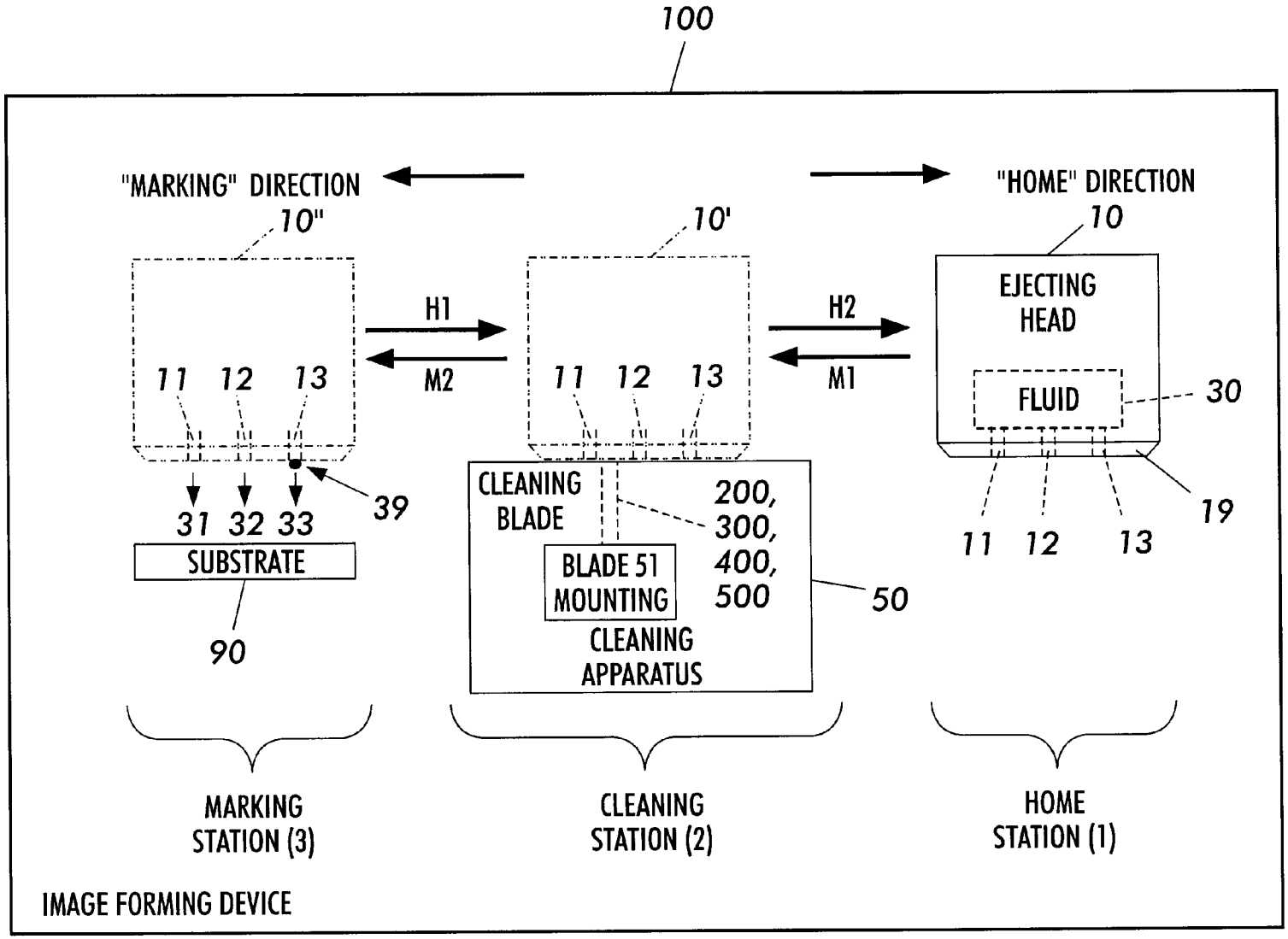
FIG. 1 depicts an image forming device 100. The image forming device 100 comprises a fluid ejecting head 10 which, in turn, includes fluid nozzle openings 11–13.

Referring now to FIG. 1 there is shown an image forming device 100 that may be arranged with a layered cleaning blade, in accordance with the present invention. As shown, the image forming device 100 comprises a home station 1, a cleaning station 2 and a marking station 3. In turn, the cleaning station 2 includes a cleaning apparatus 50.

As shown, the image forming device 100 also comprises a fluid ejecting head 10 containing a supply of a fluid 30. The fluid 30, in turn, is supplied to a plurality of included fluid nozzle openings 11, 12, 13 mounted in a faceplate 19.

While FIG. 1 depicts the fluid ejecting 10 located at or near the home station 1, the image forming device 100 comprises fluid ejecting head moving means (not shown) which moving means enable the fluid ejecting head 10 to move or travel between the home station 1, the cleaning station 2 and the marking station 3.

While the fluid ejecting head moving means included in the image forming device 100 for enabling the fluid ejecting head 10 to move between the stations 1–3 are not expressly depicted in FIG. 1, it will be understood that such fluid ejecting head moving means are common and well-known.

For example, in one embodiment, the fluid ejecting head 10 travels back and forth between the stations 1–3 by fluid ejecting head moving means similar to the carriage rod 18, carriage guide 16, belt 19 and carriage motor 27 described in col. 5, lines 23–27 of the foregoing Gast patent. In another embodiment, the fluid ejecting head 10 moves between the stations 1–3 by fluid ejecting head moving means similar to the guide shafts 9 described in col. 6, lines 58–68 and col. 7, lines 1–5 of the foregoing Nakamura patent.

In still another embodiment, the fluid ejecting head 10 travels back and forth between the stations 1–3 by fluid ejecting head moving means similar to the guide rails 18 described in col. 3, lines 27–32 of the foregoing Premnath '271 patent.

In a further embodiment, the fluid ejecting head 10 moves between the stations 1–3 by fluid ejecting head moving means similar to the guide rails 18 described in col. 3, lines 50–55 of the foregoing Ackerman patent.

In a still further embodiment, the fluid ejecting head 10 travels back and forth between the stations 1–3 by fluid ejecting head moving means similar to the guide rail 30 described in col. 3, lines 8–11 of the foregoing Premnath '071 patent.

In still yet another embodiment, the fluid ejecting head 10 moves between the stations 1–3 by fluid ejecting head moving means similar to the scanning rail 4 described in col. 4, lines 60–64 of the foregoing Uchida patent Still referring to FIG. 1, from the home station 1, the fluid ejecting head 10 is thus arranged to move in a "Marking" direction, that is, toward the marking station 3. By moving in the "Marking" direction, the fluid ejecting head 10 thereby initially arrives at the cleaning station 2. This movement or transition of the fluid ejecting head 10 in the "Marking" direction from the home station 1 to the cleaning station 2 is depicted in FIG. 1 by a first arrow labeled "M1"Also, whilst the fluid ejecting head 10 is located at the cleaning station 2, the fluid ejecting head 10 is depicted in FIG. 1 in broken lines, together with a first supplemental reference number 10'. From the cleaning station 2, as the fluid ejecting head 10 continues to move in the "Marking" direction, the fluid ejecting head 10 ultimately arrives at the marking station 3. This further transition of the fluid ejecting head 10 in the "Marking" direction from the cleaning station 2 to the marking station 3 is depicted in FIG. 1 by a second arrow labeled "M2"Also, whilst the fluid ejecting head 10 is located at the marking station 3, the fluid ejecting head 10 is depicted in FIG. 1 in broken lines, together with a second supplemental reference number 10".

Still referring to FIG. 1, whilst the fluid ejecting head 10 is located at the marking station 3, as shown, the fluid ejecting head 10 together with its included fluid nozzle openings 11–13 is thus located in close proximity to a substrate 90. The fluid ejecting head 10 being so located, the fluid nozzle openings 11–13 are thus arranged to dispose a plurality of jets or drops 31, 32, 33 of the fluid 30 on the substrate 90.

In one embodiment, the fluid 30 comprises a marking fluid, such as ink.

In another embodiment, the image forming device 100 comprises an ink jet printer.

In a further embodiment, the substrate 90 comprises paper.

Still referring to FIG. 1, from the marking station 3, the fluid ejecting head 10 is thus further arranged to move in a "Home" direction, that is, toward the home station 1. Thus, by moving in the "Home" direction, the fluid ejecting head 10 again arrives at the cleaning station 2. This transition of the fluid ejecting head 10 in the "Home" direction from the marking station 3 to the cleaning station 2 is depicted in FIG. 1 by a third arrow labeled "H1".

From the cleaning station 2, as the fluid ejecting head 10 continues to move in the "Home" direction, the fluid ejecting head 10 ultimately arrives back at the home station 1. This further transition of the fluid ejecting head 10 in the "Home" direction from the cleaning station 2 to the home station 1 is depicted in FIG. 1 by a fourth arrow labeled "H2"

Refer now to the FIG. 1 depiction of the fluid ejecting head 10 located at the marking station 3, depicted by the reference number 10". Whilst the fluid ejecting head 10 is located at the marking station 3, as a result of the fluid ejecting head 10 disposing 31–33 the fluid 30 on the substrate 90, eventually a certain amount of excess fluid 30 accrues on or near the fluid nozzle openings 11–13. In FIG. 1, this excess fluid 30 that has accrued on or near the fluid nozzle openings 11–13 is depicted by the reference number 39.

Refer now to the FIG. 1 depiction of the fluid ejecting head 10 located at the cleaning station 2, depicted by the reference number 10'. Whilst the fluid ejecting head 10 is located at the cleaning station 2, the cleaning apparatus 50 is arranged to clean the fluid nozzle openings 11–13 in order to reduce any excess fluid 39 that has accrued thereon. As shown in FIG. 1, the cleaning apparatus 50 comprises a cleaning blade mounting apparatus 51 arranged with one or more layered cleaning blades in accordance with the present invention.

Moreover, as explained in greater detail below, the cleaning apparatus 50 is thus arranged with any of the layered cleaning blade 200, the layered cleaning blade 300, the layered cleaning blade 400 and the layered cleaning blade 500.

The layered cleaning blades 200, 300, 400 and 500 will now be described.

Figure 2:
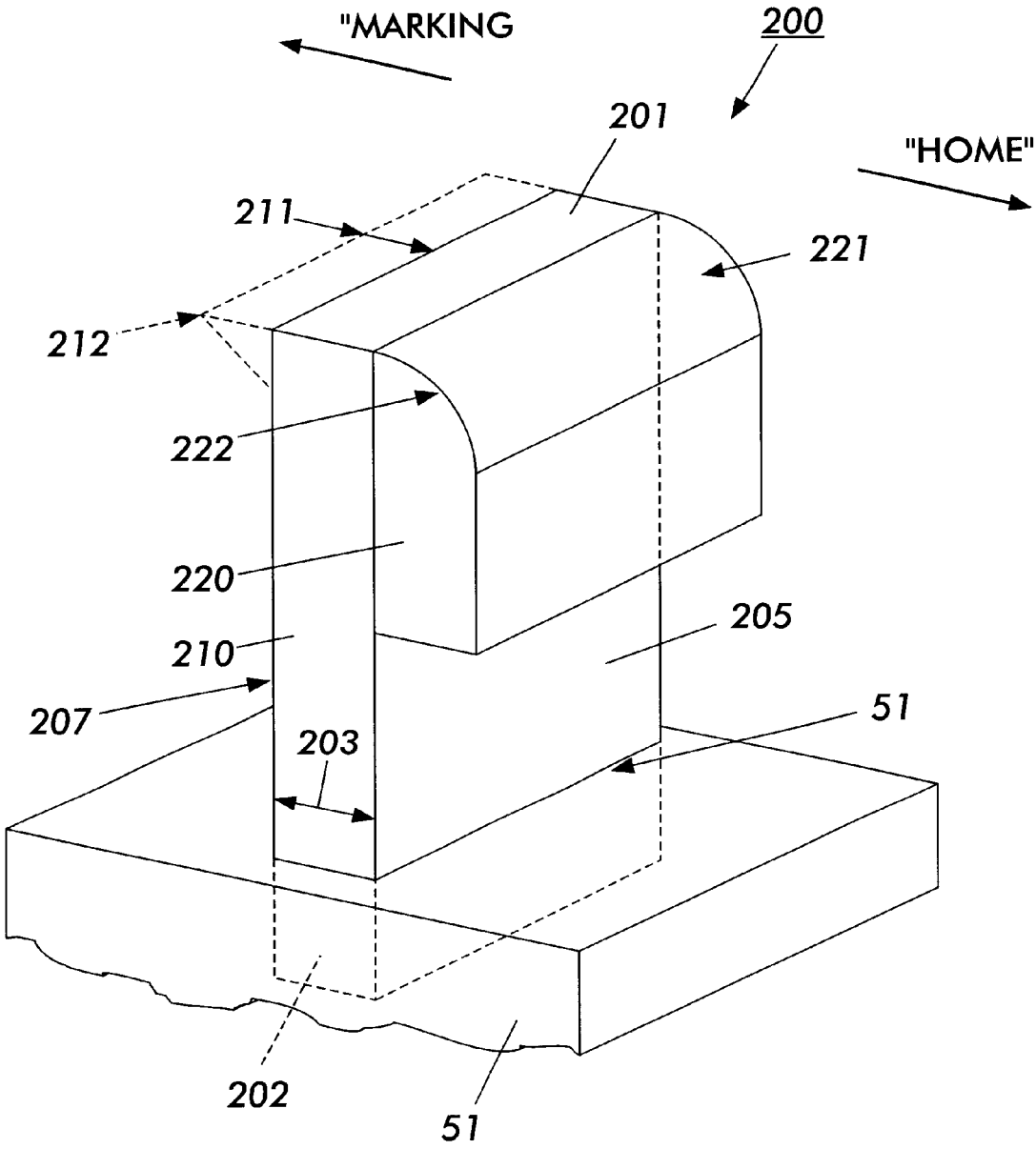
FIGS. 2–3 depict a layered cleaning blade 200 in accordance with the present invention.
Figure 3:
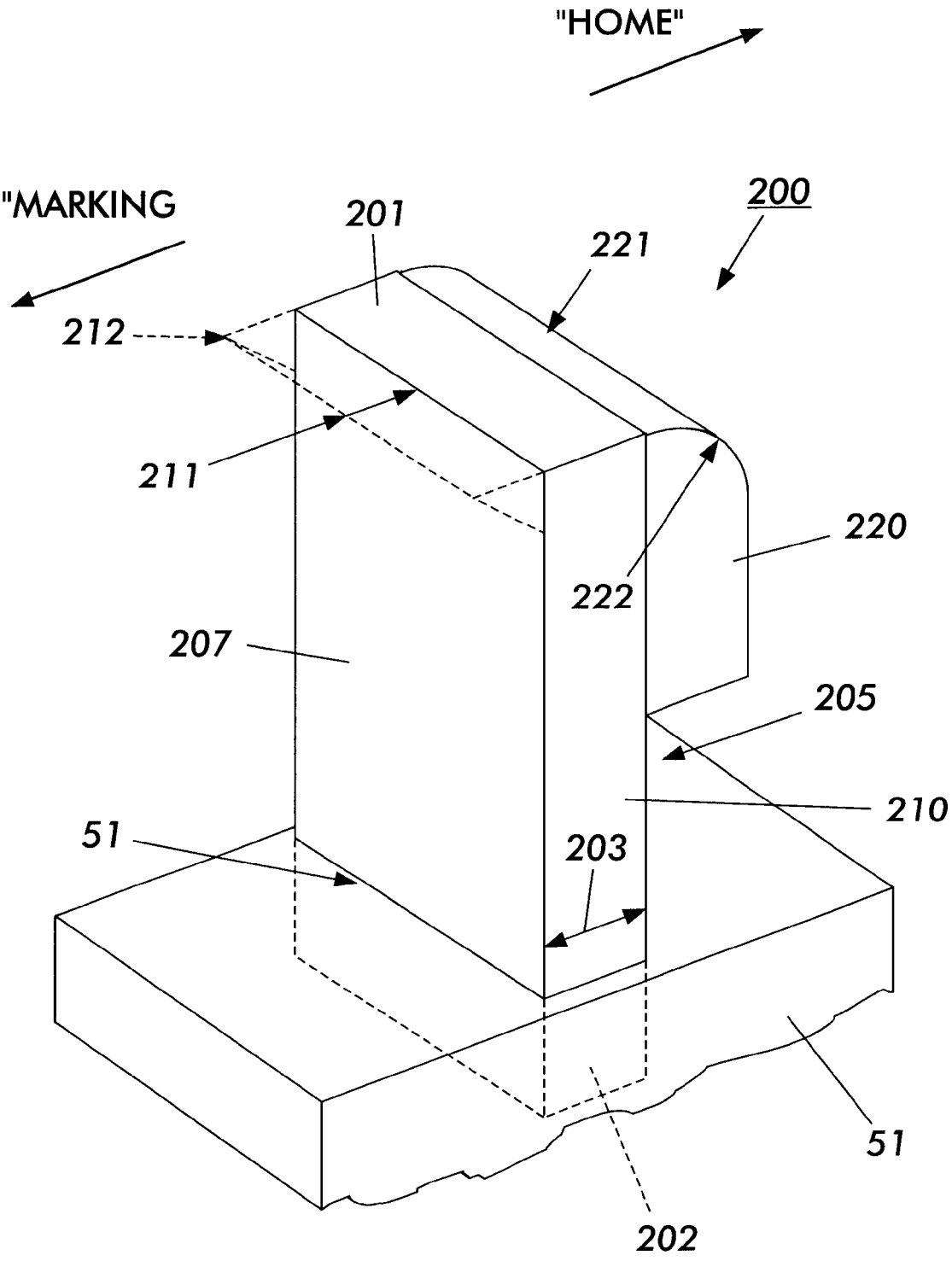

Referring now generally to FIGS. 2–3, there is shown a layered cleaning blade 200 comprising an elongated flat blade body 210 forming a flat first surface 205, a thickness 203 and an opposite flat second surface 207, a cleaning end 201 and a distal mounting end 202 arranged to mount 51 in the cleaning apparatus 50 of the FIG. 1 image forming device 100.

Referring now to FIG. 2, as shown therein, a smaller flat wiper blade 220 is disposed on the first surface 205 with an outer wiper surface 221 near the cleaning end 201. The wiper surface 221 is comprised of a relatively low-hardness material.

Figure 4:
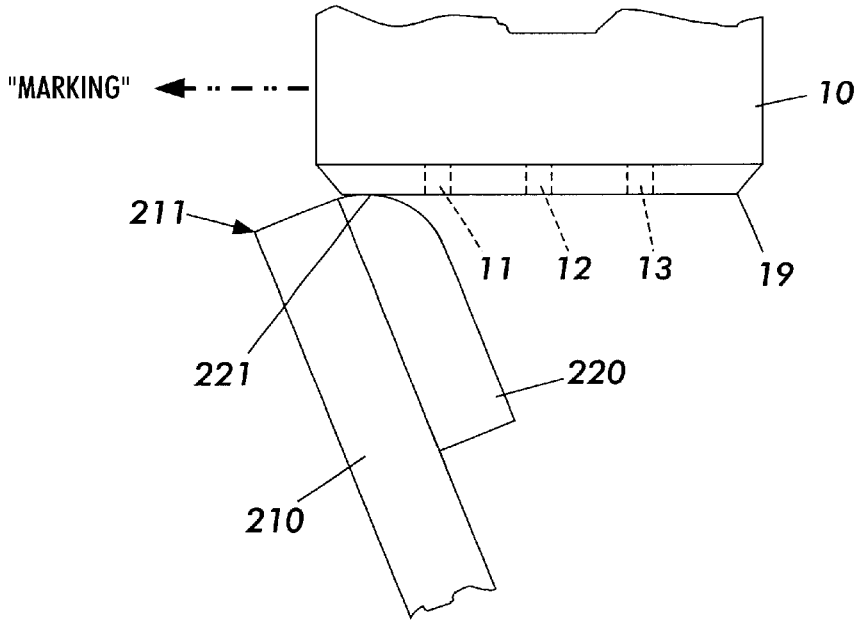
FIG. 4 depicts the layered cleaning blade 200 wiping the fluid nozzle openings 11–13 as the fluid ejecting head 10 moves in a "Marking" direction.

Referring now to FIG. 4, as shown therein, the wiper surface 221 is arranged for wiping fluid nozzle openings 11–13 of the included fluid ejecting head 10 as it moves in the "Marking" direction toward the wiper surface 221.

Returning now to FIGS. 2–3, as shown therein, the second surface 207 forms a scraper edge 211 near the cleaning end 201. The scraper edge 211 is comprised of a relatively high-hardness material.

Figure 5:
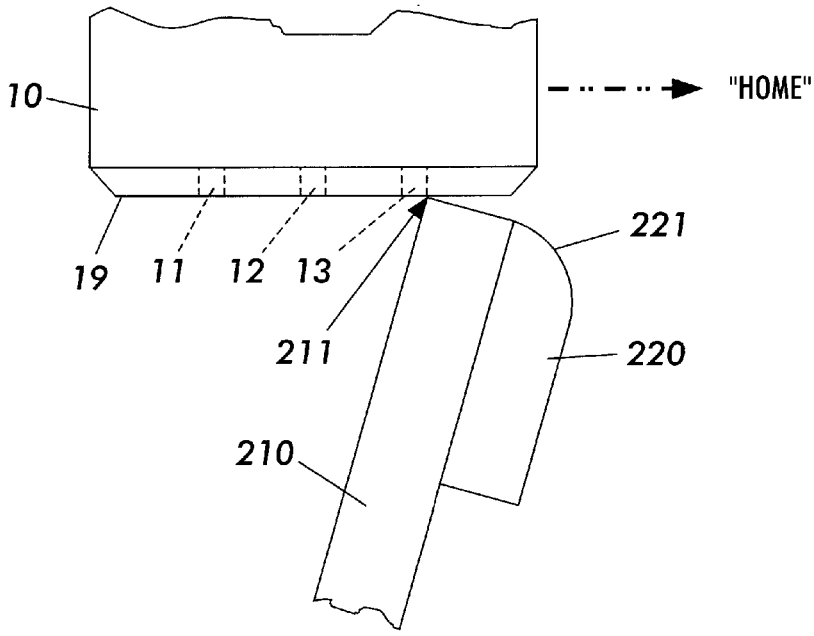
FIG. 5 depicts the layered cleaning blade 200 scraping the fluid nozzle openings 11–13 as the fluid ejecting head 10 moves in a "Home" direction.

Referring now to FIG. 5, as shown therein, the scraper edge 211 is arranged for scraping the fluid nozzle openings 11–13 as the fluid ejecting head 10 moves in the "Home" direction. Returning now to FIG. 2, as shown therein, in one embodiment, the wiper surface 221 is tapered 222 inwards toward the cleaning end 201 to form a generally smooth wiper surface 221.

Returning now to FIG. 3, as shown therein, in one embodiment, the scraper edge 211 forms a pointed lip 212 protruding outward away from the cleaning end 201 to form a generally pointed scraper edge 211.

In one embodiment, the wiper surface 221 is characterized by a hardness of 45–60, Shore A.

It will be understood that the "Shore A" hardness scale is defined in ASTM D2240-00.

In another embodiment, the scraper edge 211 characterized by a hardness of 60–80, Shore A.

In one embodiment, the elongated flat blade body 210 is comprised of urethane.

In another embodiment, the smaller flat wiper blade 220 is comprised of urethane.

In one embodiment, the elongated flat blade body 210 thickness 203 is about 3–8 mm.

In one embodiment, the smaller flat wiper blade 220 is disposed on the elongated flat blade body 210 flat first surface 205 by means of a suitable adhesive.

Figure 6:
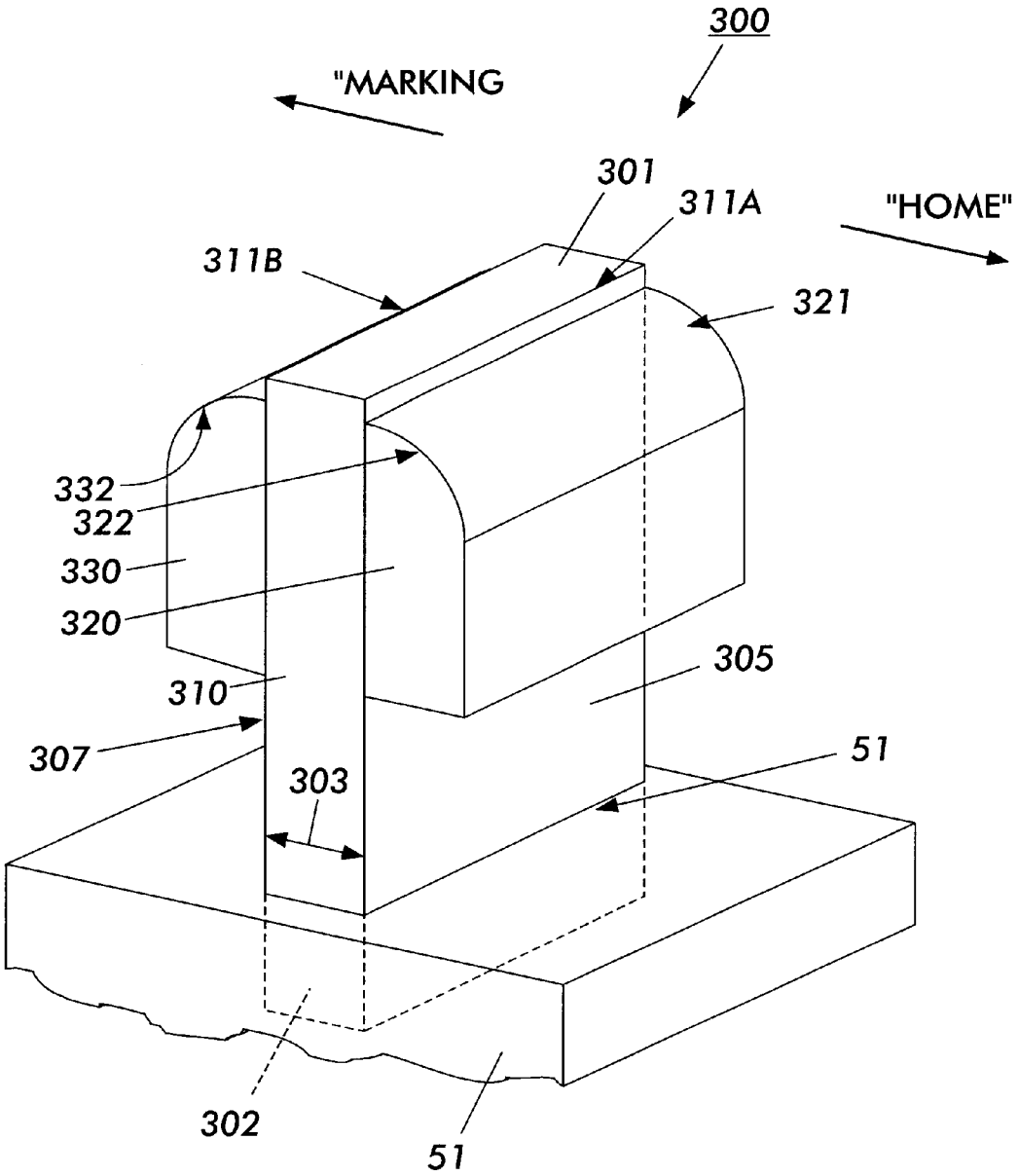
FIGS. 6–7 depict a layered cleaning blade 300 in accordance with the present invention.
Figure 7:
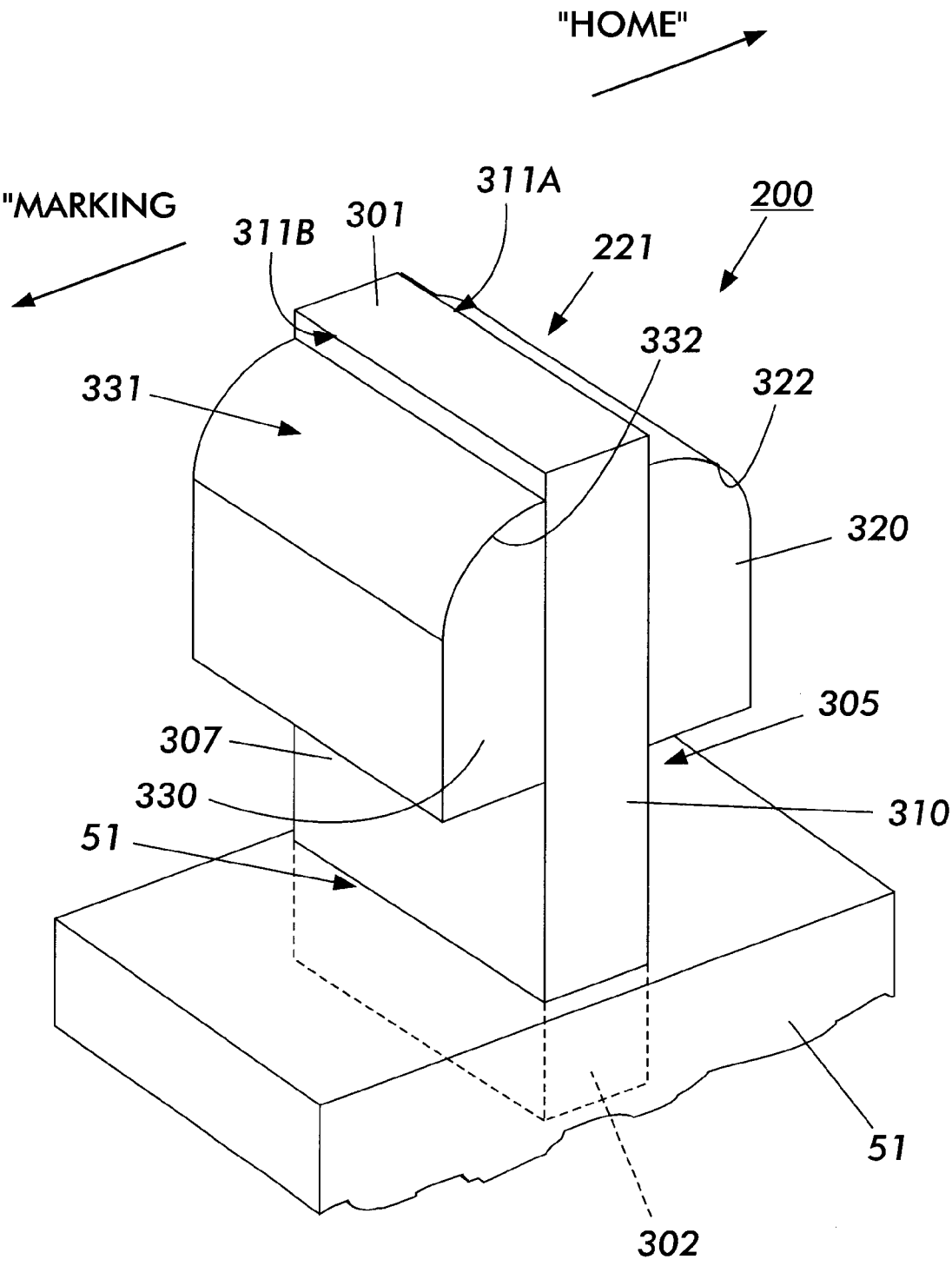

Referring now generally to FIGS. 6–7, there is shown a layered cleaning blade 300 comprising an elongated flat blade body 310 forming a flat first surface 305, a thickness 303 and an opposite flat second surface 307, a cleaning end 301 and a distal mounting end 302 arranged to mount 51 in the cleaning apparatus 50 of the FIG. 1 image forming device 100.

Referring now to FIG. 6, as shown therein, a smaller first flat wiper blade 320 is disposed on the first surface 305 near the cleaning end 301 to expose a first scraper edge 311A comprised in the cleaning end 301. As shown, the outer surface of the first wiper blade 320 near the cleaning end 301 forms a first wiper surface 321. The first wiper surface 321 is comprised of a relatively low-hardness material. The first scraper edge 311A is comprised of a relatively high-hardness material.

Figure 8:
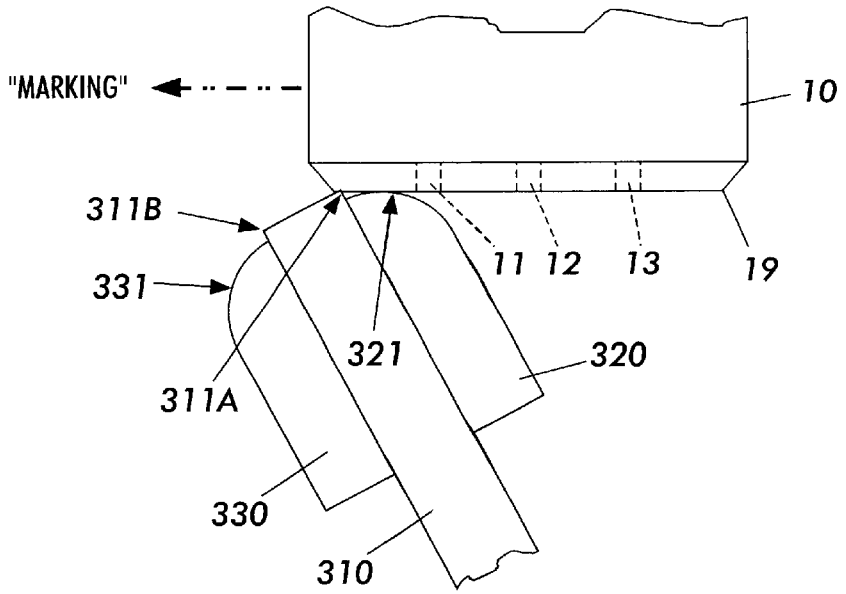
FIG. 8 depicts the layered cleaning blade 300 wiping and scraping the fluid nozzle openings 11–13 as the fluid ejecting head 10 moves in the "Marking" direction.

Referring now to FIG. 8, as shown therein, the first wiper surface 321 is arranged for wiping fluid nozzle openings 11–13 of the included fluid ejecting head 10 as it moves in the "Marking" direction toward the first wiper surface 321. Still referring to FIG. 8, the first scraper edge 311A is arranged for later scraping the fluid nozzle openings 11–13 as the fluid ejecting head 10 further moves in the "Marking" direction.

Referring now to FIG. 7, as shown therein, a smaller second flat wiper blade 330 is disposed on the second surface 307 near the cleaning end 301 to expose a second scraper edge 311B comprised in the cleaning end 301. As shown, the outer surface of the second wiper blade 330 near the cleaning end 301 forms a second wiper surface 331. The second wiper surface 331 is comprised of a relatively low-hardness material. The second scraper edge 311B is comprised of a relatively high-hardness material.

Figure 9:
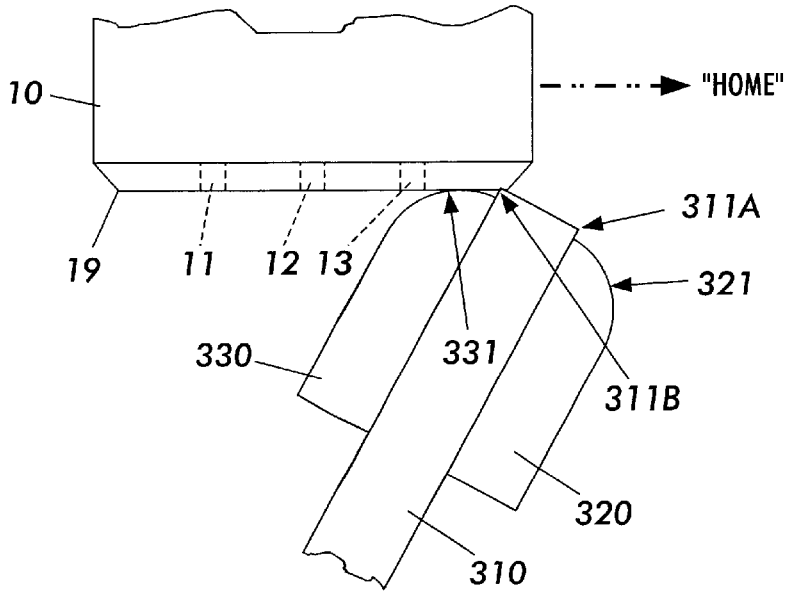
FIG. 9 depicts the layered cleaning blade 300 wiping and scraping the fluid nozzle openings 11–13 as the fluid ejecting head 10 moves in the "Home" direction.

Referring now to FIG. 9, as shown therein, the second wiper surface 331 is arranged for wiping the fluid nozzle openings 11–13 as the fluid ejecting head 10 moves in the "Home" direction toward the second wiper surface 331. Still referring to FIG. 9, the second scraper edge 311B is arranged for later scraping the fluid nozzle openings 11–13 as the fluid ejecting head 10 further moves in the "Home" direction.

Returning to FIGS. 6–7, as shown therein, in one embodiment, the first wiper surface 321 is tapered 322 inwards toward the cleaning end 301 to form a generally smooth first wiper surface 321. In another embodiment, the second wiper surface 331 is tapered 332 inwards toward the cleaning end 301 to form a generally smooth second wiper surface 331.

In one embodiment, the first wiper surface 321 is characterized by a hardness of 45–60, Shore A.

In another embodiment, the second wiper surface 331 is characterized by a hardness of 45–60, Shore A.

In one embodiment, the first scraper edge 311A is characterized by a hardness of 60–80, Shore A.

In another embodiment, the second scraper edge 311B characterized by a hardness of 60–80 Shore A.

In one embodiment, the elongated flat blade body 310 is comprised of urethane.

In another embodiment, the first wiper blade 320 and the second wiper blade 330 are comprised of urethane.

In one embodiment, the smaller first flat wiper blade 320 is disposed on the elongated flat blade body 310 flat first surface 305 by means of a suitable adhesive.

In another embodiment, the smaller second flat wiper blade 330 is disposed on the elongated flat blade body 310 flat second surface 307 by means of a suitable adhesive.

Figure 10:
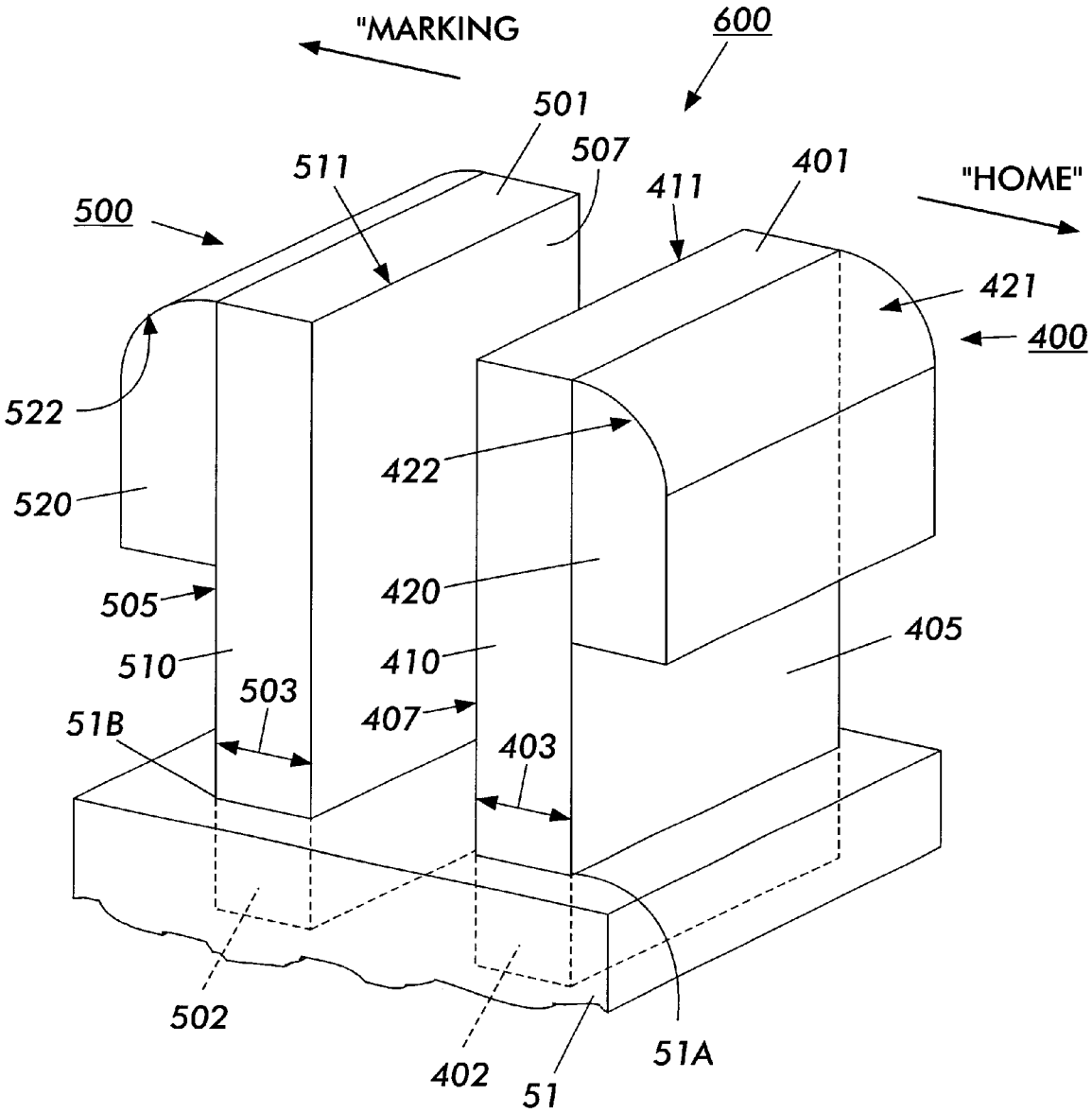
FIGS. 10–11 depict a layered cleaning blade arrangement 600 comprising a layered cleaning blade 400 and a layered cleaning blade 500, in accordance with the present invention.
Figure 11:
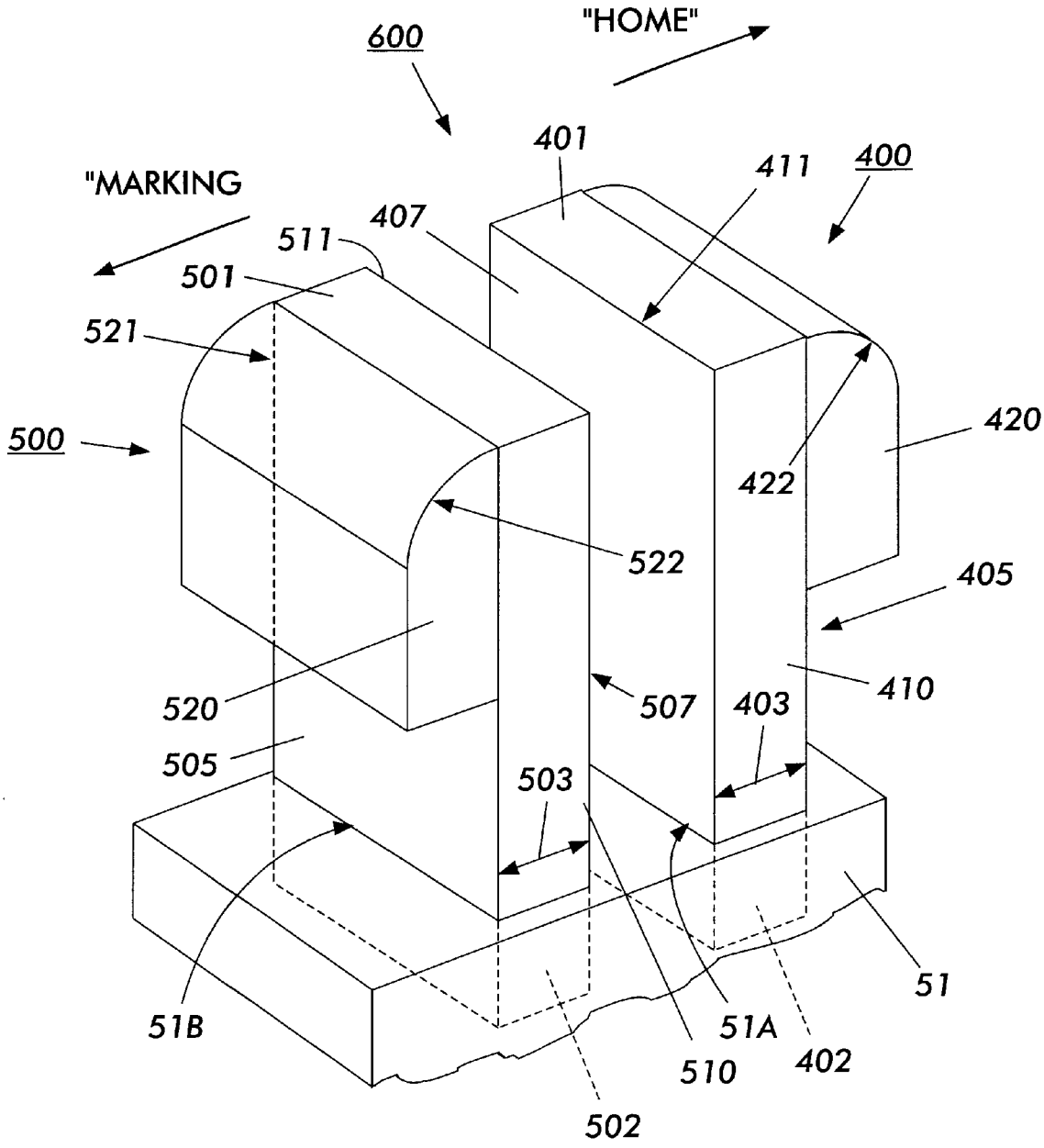

Referring now generally to FIGS. 10–11, there is depicted a layered cleaning blade 400 and a layered cleaning blade 500.

In one embodiment, the two layered cleaning blades depicted in FIGS. 10–11, namely, the first layered cleaning blade 400 and the second layered cleaning blade 500, are both arranged as shown to form a layered cleaning blade arrangement depicted by the reference number 600.

Referring now to FIG. 10, as shown therein, the first layered cleaning blade 400 comprises a first elongated flat blade body 410 forming a flat first surface 405, a first thickness 403 and an opposite flat second surface 407, a first cleaning end 401 and a distal first mounting end 402 arranged to mount 51A in the cleaning apparatus 50 of the FIG. 1 image forming device 100. As further shown in FIG. 10, a smaller flat first wiper blade 420 is disposed on the first surface 405 with an outer first wiper surface 421 near the first cleaning end 401. The first wiper surface 421 is comprised of a relatively low-hardness material.

Referring now to FIG. 11, as shown therein, the second surface 407 forms a first scraper edge 411 near the first cleaning end 401. The first scraper edge 411 is comprised of a relatively high-hardness material.

Still referring to FIG. 11, as further shown therein, the second layered cleaning blade 500 comprises a second elongated flat blade body 510 forming a flat third surface 505, a second thickness 503 and an opposite flat fourth surface 507, a second cleaning end 501 and a distal second mounting end 502 arranged to mount 51B in the cleaning apparatus 50 of the FIG. 1 image forming device 100. As further shown in FIG. 11, a smaller flat second wiper blade 520 is disposed on the third surface 505 with an outer second wiper surface 521 near the second cleaning end 501. The second wiper surface 521 is comprised of a relatively low-hardness material.

Returning now to FIG. 10, as shown therein, the fourth surface 507 forms a second scraper edge 511 near the second cleaning end 501. The second scraper edge 511 is comprised of a relatively high-hardness material.

Figure 12:
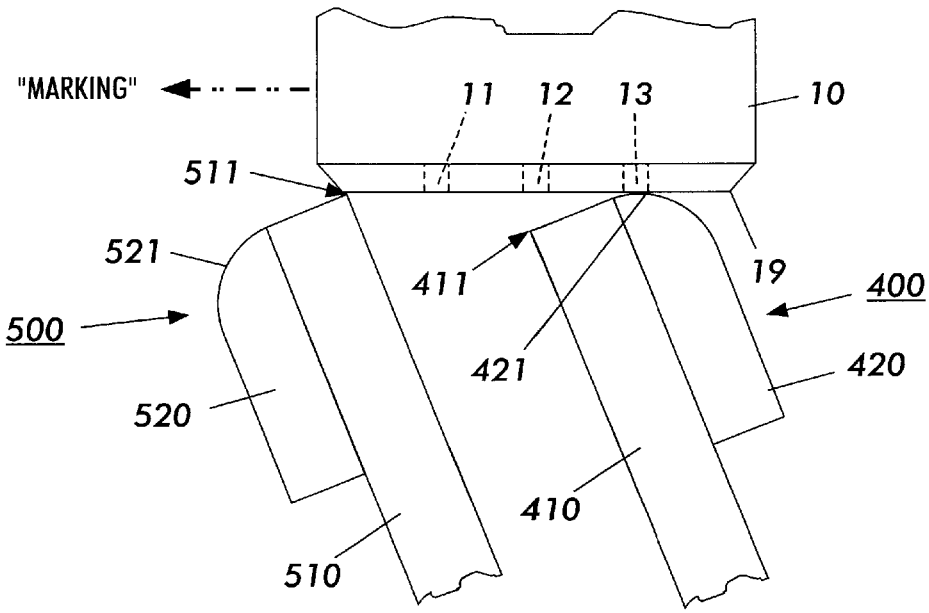
FIG. 12 depicts the layered cleaning blade 400 wiping the fluid nozzle openings 11–13 and the layered cleaning blade 500 scraping the fluid nozzle openings 11–13 as the fluid ejecting head 10 moves in the "Marking" direction.

Referring now to FIG. 12, as shown therein, the first wiper surface 421 is arranged for wiping the fluid nozzle openings 11–13 of the included fluid ejecting head 10 as it moves in the "Marking" direction toward the first wiper surface 421. As further shown in FIG. 12, the second scraper edge 511 is arranged for later scraping the fluid nozzle openings 11–13 as the fluid ejecting head 10 further moves in the "Marking" direction.

Figure 13:
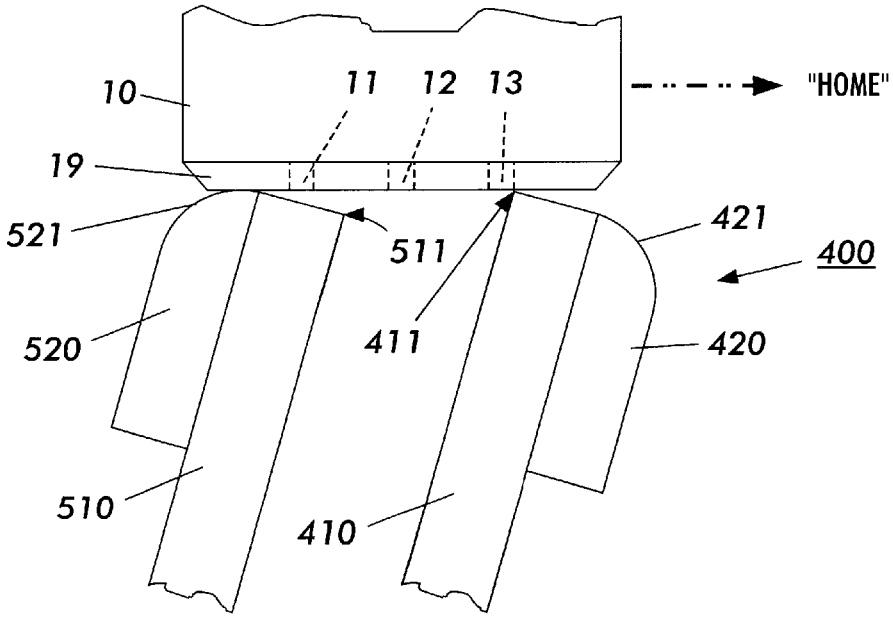
FIG. 13 depicts the layered cleaning blade 500 wiping the fluid nozzle openings 11–13 and the layered cleaning blade 400 scraping the fluid nozzle openings 11–13 as the fluid ejecting head 10 moves in the "Home" direction.

Referring now to FIG. 13, as shown therein, the second wiper surface 521 is arranged for wiping the fluid nozzle openings 11–13 as the fluid ejecting head 10 moves in the "Home" direction toward the second wiper surface 521. As further shown in FIG. 13, the first scraper edge 411 is arranged for later scraping the fluid nozzle openings 11–13 as the fluid ejecting head 10 further moves in the "Home" direction.

Returning now to FIG. 10, as shown therein, in one embodiment, the first wiper surface 421 is tapered 422 inwards toward the first cleaning end 401 to form a generally smooth first wiper surface 421.

Returning now to FIG. 11, as shown therein, in one embodiment, the second wiper surface 521 is tapered 522 inwards toward the second cleaning end 501 to form a generally smooth second wiper surface 521.

In one embodiment, the first wiper surface 421 is characterized by a hardness of 45–60, Shore A.

In another embodiment, the second wiper surface 521 is characterized by a hardness of 45–60, Shore A.

In one embodiment, the first scraper edge 411 is characterized by a hardness of 60–80 Shore A.

In another embodiment, the second scraper edge 511 is characterized by a hardness of 60–80, Shore A.

In one embodiment, the first elongated flat blade body 410 is comprised of urethane and the second elongated flat blade body 510 comprised of urethane.

In another embodiment, the first wiper blade 420 is comprised of urethane and the second wiper blade 520 is comprised of urethane.

In one embodiment, the smaller flat first wiper blade 420 is disposed on the first elongated flat blade body 410 flat first surface 405 by means of a suitable adhesive.

In another embodiment, the smaller flat second wiper blade 520 is disposed on the second elongated flat blade body 510 flat third surface 505 by means of a suitable adhesive.

Referring again to FIG. 1, it will be understood that the image forming device 100 depicted therein may be arranged with one or more of any of the layered cleaning blade 200 depicted in FIGS. 2–5, the layered cleaning blade 300 depicted in FIGS. 6–9, the layered cleaning blade 400 depicted in FIGS. 10–13, the layered cleaning blade 500 depicted in FIGS. 10–13 and the layered cleaning blade arrangement 600 depicted in FIGS. 10–13.

Thus, still referring to FIG. 1, with cross-reference to FIGS. 2–5, in one embodiment, the FIG. 1 image forming device 100 is arranged with one or more of the layered cleaning blade 200 depicted in FIGS. 2–5 and described hereinabove in connection therewith.

Still referring to FIG. 1, with cross-reference to FIGS. 6–9, in another embodiment, the FIG. 1 image forming device 100 is arranged with one or more of the layered cleaning blade 300 depicted in FIGS. 6–9 and described hereinabove in connection therewith.

Still referring to FIG. 1, with cross-reference to FIGS. 10–13, in still another embodiment, the FIG. 1 image forming device 100 is arranged with one or more of the layered cleaning blade 400 depicted in FIGS. 10–13 and described hereinabove in connection therewith.

Still referring to FIG. 1, with cross-reference to FIGS. 10–13, in a further embodiment, the FIG. 1 image forming device 100 is arranged with one or more of the layered cleaning blade 500 depicted in FIGS. 10–13 and described hereinabove in connection therewith.

Still referring to FIG. 1, with cross-reference to FIGS. 10–13, in a still further embodiment, the FIG. 1 image forming device 100 is arranged with one or more of the layered cleaning blade arrangement 600 comprising the layered cleaning blade 400 and the layered cleaning blade 500, as depicted in FIGS. 10–13 and described hereinabove in connection therewith.

Still referring to FIG. 1, in one embodiment, the image forming device 100 is arranged with any number or combination or both of a plurality of the layered cleaning blades 200, 300, 400 and 500 and the layered cleaning blade arrangement 600, in accordance with the present invention.

Still referring to FIG. 1, in one embodiment, the fluid 30 comprises a marking fluid.

In another embodiment, the marking fluid comprises ink. In still another embodiment image forming device 100 comprises an ink jet printer.

In a further embodiment, the ink comprises a single ink color.

In a still further embodiment, the single ink color comprises the color "Black".

In yet another embodiment, the ink comprises a plurality of ink colors.

In a still yet further embodiment, the plurality of ink colors comprises the colors "Magenta", "Yellow", "Cyan" and "Black".

In summary, there is described a layered cleaning blade, in accordance with the present invention, including the layered cleaning blade 200, the layered cleaning blade 300, the layered cleaning blade 400 and the layered cleaning blade 500, which layered cleaning blade provides both a relatively low-hardness wiper surface and a relatively high-hardness scraper edge. The layered cleaning blade thus combines both a wiping function and a scraping function in a single cleaning blade unit.

In one embodiment, the layered cleaning blade is used to clean the fluid nozzle openings 11–13 of the proximately-located fluid ejecting head 10.

In another embodiment, the foregoing cleaning of the fluid nozzle openings 11–13 by the layered cleaning blade acts to reduce any excess fluid 39 that has accrued in the vicinity of the fluid nozzle openings 11–13.

Further, there is described a layered cleaning blade arrangement 600, in accordance with the present invention, comprising the arrangement of the layered cleaning blade 400 and the layered cleaning blade 500.

Further, in accordance with the present invention, there is described an image forming device 100 arranged with any number or combination or both of the layered cleaning blade 200, the layered cleaning blade 300, the layered cleaning blade 400, the layered cleaning blade 500 and the layered cleaning blade arrangement 600.

While various embodiments of a layered cleaning blade and image forming device arranged with the same, in accordance with the present invention, are described hereinabove, the scope of the invention is defined by the following claims.

What is claimed is:

1. A layered cleaning blade comprising an elongated flat blade body forming a flat first surface, a thickness and an opposite flat second surface, a cleaning end and a distal mounting end, a smaller first flat wiper blade disposed on the first surface near the cleaning end to expose a first scraper edge comprised in the cleaning end, an outer surface of the first wiper blade near the cleaning end forming a first wiper surface comprised of a relatively low-hardness material, the first scraper edge comprised of a relatively high-hardness material, and a smaller second flat Wiper blade disposed on the second surface near the cleaning end to expose a second scraper edge comprised in the cleaning end, the outer surface of the second wiper blade near the cleaning end forming a second wiper surface comprised of a relatively low-hardness material, the second scraper edge comprised of a relatively high-hardness material.

2. The layered cleaning blade of claim 1, the distal mounting end arranged to mount in a cleaning apparatus of an image forming device, the first wiper surface arranged for wiping fluid nozzle openings of a fluid ejecting head comprised in the image forming device as the fluid ejecting head moves in a first direction toward the first wiper surface, the first scraper edge arranged for later scraping the fluid nozzle openings as the fluid ejecting head further moves in the first direction, the second wiper surface arranged for wiping the fluid nozzle openings as the fluid ejecting head moves in a second direction toward the second wiper surface, the second scraper edge arranged for later scraping the fluid nozzle openings as the fluid ejecting head further moves in the second direction.

3. The layered cleaning blade of claim 2, the fluid comprising ink.

4. The layered cleaning blade of claim 3, the image forming device comprising an ink jet printer.

5. The layered cleaning blade of claim 1, the first wiper surface tapered inwards toward the cleaning end to form a generally smooth first wiper surface, the second wiper surface tapered inwards toward the cleaning end to form a generally smooth second wiper surface.

6. The layered cleaning blade of claim 1, the first wiper surface characterized by a hardness of 45–60, Shore A.

7. The layered cleaning blade of claim 1, the second wiper surface characterized by a hardness of 45–60, Shore A.

8. The layered cleaning blade of claim 1, the first scraper edge characterized by a hardness of 60–80, Shore A.

9. The layered cleaning blade of claim 1, the second scraper edge characterized by a hardness of 60–80, Shore A.

10. The layered cleaning blade of claim 1, the elongated flat blade body comprised of urethane.

11. A layered cleaning blade arrangement comprising a first layered cleaning blade comprising a first elongated flat blade body forming a flat first surface, a first thickness and an opposite flat second surface, a first cleaning end and a distal first mounting end, a smaller flat first wiper blade disposed on the first surface with an outer first wiper surface near the first cleaning end comprised of a relatively low-hardness material, the second surface forming a first scraper edge near the first cleaning end comprised of a relatively high-hardness material, and a second layered cleaning blade comprising a second elongated flat blade body forming a flat third surface, a second thickness and an opposite flat fourth surface, a second cleaning end and a distal second mounting end, a smaller flat second wiper blade disposed on the third surface with an outer second wiper surface near the second cleaning end comprised of a relatively low-hardness material, the fourth surface forming a second scraper edge near the second cleaning end comprised of a relatively high-hardness material.

12. The layered cleaning blade arrangement of claim 11, the distal first mounting end arranged to mount in a cleaning apparatus of an image forming device, the distal second mounting end arranged to mount in the cleaning apparatus, the first wiper surface arranged for wiping fluid nozzle openings of a fluid ejecting head comprised in the image forming device as the fluid ejecting head moves in a first direction toward the first wiper surface, the second scraper edge arranged for later scraping the fluid nozzle openings as the fluid ejecting head further moves in the first direction, the second wiper surface arranged for wiping the fluid nozzle openings as the fluid ejecting head moves in a second direction toward the second wiper surface, and the first scraper edge arranged for later scraping the fluid nozzle openings as the fluid ejecting head further moves in the second direction.

13. The layered cleaning blade arrangement of claim 12, the fluid comprising ink.

14. The layered cleaning blade arrangement of claim 11, the first wiper surface tapered inwards toward the first cleaning end to form a generally smooth first wiper surface, the second wiper surface tapered inwards toward the second cleaning end to form a generally smooth second wiper surface.

15. The layered cleaning blade arrangement of claim 11, the first wiper surface characterized by a hardness of 45–60, Shore A.

16. The layered cleaning blade arrangement of claim 12, the second wiper surface characterized by a hardness of 45–60, Shore A.

17. The layered cleaning blade arrangement of claim 11, the first scraper edge characterized by a hardness of 60–80, Shore A.

18. The layered cleaning blade arrangement of claim 11, the second scraper edge characterized by a hardness of 60–80, Shore A.

19. The layered cleaning blade arrangement of claim 11, the first elongated flat blade body comprised of urethane, the second elongated flat blade body comprised of urethane.

20. The layered cleaning blade arrangement of claim 11, the first wiper blade comprised of urethane, the second wiper blade comprised of urethane.

21. An image forming device arranged with one or more layered cleaning blades, at least one of the one or more layered cleaning blades comprising an elongated flat blade body forming a flat first surface, a thickness and an opposite flat second surface, a cleaning end and a distal mounting end, a smaller first flat wiper blade disposed on the first surface near the cleaning end to expose a first scraper edge comprised in the cleaning end, an outer surface of the first wiper blade near the cleaning end forming a first wiper surface comprised of a relatively low-hardness material, the first scraper edge comprised of a relatively high-hardness material, and a smaller second flat wiper blade disposed on the second surface near the cleaning end to expose a second scraper edge comprised in the cleaning end, the outer surface of the second wiper blade near the cleaning end forming a second wiper surface comprised of a relatively low-hardness material, the second scraper edge comprised of a relatively high-hardness material.

22. The image forming device of claim 21, the image forming device comprising a cleaning apparatus and a fluid ejecting head including fluid nozzle openings, the distal mounting end arranged to mount in the cleaning apparatus, the first wiper surface arranged for wiping the fluid nozzle openings as the fluid ejecting head moves in a first direction toward the first wiper surface, the first scraper edge arranged for later scraping the fluid nozzle openings as the fluid ejecting head further moves in the first direction, the second wiper surface arranged for wiping the fluid nozzle openings as the fluid ejecting head moves in a second direction toward the second wiper surface, the second scraper edge arranged for later scraping the fluid nozzle openings as the fluid ejecting head further moves in the second direction.

23. The image forming device of claim 21, the first wiper surface tapered inwards toward the cleaning end to form a generally smooth first wiper surface.

24. The image forming device of claim 21, the second wiper surface tapered inwards toward the cleaning end to form a generally smooth second wiper surface.

25. The image forming device of claim 21, comprising only a single layered cleaning blade.

26. The image forming device of claim 25, the fluid comprising ink, the image forming device comprising an ink jet printer.

27. The image forming device of claim 21, the first wiper surface characterized by a hardness of 45–60, Shore A.

28. The image forming device of claim 21, the second wiper surface characterized by a hardness of 45–60, Shore A.

29. The image forming device of claim 21, the first scraper edge characterized by a hardness of 60–80, Shore A.

30. The image forming device of claim 21, the second scraper edge characterized by a hardness of 60–80, Shore A.

31. An image forming device arranged with one or more layered cleaning blade arrangements, at least one of the one or more layered cleaning blade arrangements comprising a first layered cleaning blade comprising a first elongated flat blade body forming a flat first surface, a first thickness and an opposite flat second surface, a first cleaning end and a distal first mounting end, a smaller flat first wiper blade disposed on the first surface with an outer first wiper surface near the first cleaning end comprised of a relatively low-hardness material, the second surface forming a first scraper edge near the first cleaning end comprised of a relatively high-hardness material, and a second layered cleaning blade comprising a second elongated flat blade body forming a flat third surface, a second thickness and an opposite flat fourth surface, a second cleaning end and a distal second mounting end, a smaller flat second wiper blade disposed on the third surface with an outer second wiper surface near the second cleaning end comprised of a relatively low-hardness material, the fourth surface forming a second scraper edge near the second cleaning end comprised of a relatively high-hardness material.

32. The image forming device of claim 31, the image forming device comprising a cleaning apparatus and a fluid ejecting head including fluid nozzle openings, the distal first mounting end arranged to mount in the cleaning apparatus, the distal second mounting end arranged to mount in the cleaning apparatus, the first wiper surface arranged for wiping the fluid nozzle openings as the fluid ejecting head moves in a first direction toward the first wiper surface, the second scraper edge arranged for later scraping the fluid nozzle openings as the fluid ejecting head further moves in the first direction, the second wiper surface arranged for wiping the fluid nozzle openings as the fluid ejecting head moves in a second direction toward the second wiper surface, and the first scraper edge arranged for later scraping the fluid nozzle openings as the fluid ejecting head further moves in the second direction.

33. The image forming device of claim 31, the first wiper surface tapered inwards toward the first cleaning end to form a generally smooth first wiper surface, the second wiper surface tapered inwards toward the second cleaning end to form a generally smooth second wiper surface.

34. The image forming device of claim 31, comprising only a single layered cleaning blade arrangement.

35. The image forming device of claim 34, the fluid comprising ink, the image forming device comprising an ink jet printer.

36. The image forming device of claim 31, the first wiper surface characterized by a hardness of 45–60, Shore A.

37. The image forming device of claim 31, the second wiper surface characterized by a hardness of 45–60, Shore A.

38. The image forming device of claim 31, the first scraper edge characterized by a hardness of 60–80, Shore A.

39. The image forming device of claim 31, the second scraper edge characterized by a hardness of 60–80, Shore A.

40. The image forming device of claim 31, the first elongated flat blade body comprised of urethane, the second elongated flat blade body comprised of urethane, the first wiper blade comprised of urethane, the second wiper blade comprised of urethane.

* * * * *